US005402764A

United States Patent [19]

Rossignol et al.

[11] Patent Number: 5,402,764

[45] Date of Patent: Apr. 4, 1995

[54] FUEL INJECTION PUMP FOR INTERNAL COMBUSTION ENGINES

[75] Inventors: Francois Rossignol, Mornant; Francois Agrain, St. Pierre de Chandieu, both of France

[73] Assignee: Robert Bosch GmbH, Stuttgart, Germany

[21] Appl. No.: 147,274

[22] Filed: Nov. 5, 1993

[51] Int. Cl.[6] ..... F02M 37/04

[52] U.S. Cl. ..... 123/508; 123/495; 123/90.61

[58] Field of Search ..... 123/500, 501, 446, 495, 123/90.61, 90.62; 239/88–96

[56] References Cited

U.S. PATENT DOCUMENTS

| | | | |
|---|---|---|---|
| 2,897,805 | 8/1959 | Etzler | 123/90.61 |
| 4,206,734 | 6/1980 | Perr | 123/501 |
| 4,407,241 | 10/1983 | Butler | 123/501 |
| 4,531,672 | 7/1985 | Smith | 123/446 |
| 4,794,894 | 1/1989 | Gill | 123/508 |
| 4,864,983 | 9/1989 | Breitbarth | 123/90.61 |
| 4,957,090 | 9/1990 | Rathmayr | 123/501 |
| 4,966,108 | 10/1990 | Bentz | 123/508 |
| 5,102,047 | 4/1992 | Rossignol | 239/88 |
| 5,320,278 | 6/1994 | Kolarik | 123/446 |

FOREIGN PATENT DOCUMENTS

| | | | |
|---|---|---|---|
| 547612 | 10/1957 | Canada | 123/509 |
| 3943419 | 4/1991 | Germany . | |
| 24127 | of 1913 | United Kingdom . | |
| 0375151 | 6/1932 | United Kingdom . | |
| 211377 | 8/1983 | United Kingdom . | |
| 9210668 | 6/1992 | WIPO . | |

*Primary Examiner*—Carl S. Miller

*Attorney, Agent, or Firm*—Edwin E. Greigg; Ronald E. Greigg

[57] ABSTRACT

A fuel injection apparatus for internal combustion engines, having a pump piston, which is guided in a cylinder bore and driven to reciprocate by a cam drive. The pump piston defines a pump work chamber with its face end. The pump work chamber communicates with an injection valve via a pressure conduit and is supplied with fuel and relieved via a fuel line. The cam drive acts upon the pump piston via a rocker bolt, a tappet bolt, and a tappet insert, and the connections from the tappet bolt to both the rocker bolt and the tappet insert are embodied in the manner of ball joints. For simple installation of the tappet bolt, it is axially secured in relation to the rocker and to a tappet sleeve, which receives the tappet insert, via securing elements having elastic stretching properties, which expand to the size of the outer diameter of the ball head when a certain force is exerted, so that the tappet bolt can be installed and removed without disassembling the whole pump.

20 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines. In a fuel pump of this type known from German Offenlegungsschrift DE-OS 39 43 419; U.S. Pat. No. 5,102,047 a pump piston is axially guided in a cylinder bore of a pump housing and is driven back and forth by a cam drive. With its face end remote from the cam drive, the pump piston defines a pump work chamber in the cylinder bore into which a fuel line discharges and which communicates with an injection valve, which protrudes into the combustion chamber of the engine to be supplied, via a pressure line. The onset of high pressure delivery of the fuel in the pump work chamber and consequently the onset of injection as well as the quantity of fuel to be injected is electrically controlled by means of the closing time of a magnet valve disposed in the fuel line, dependent upon the operating parameters of the engine to be supplied.

The transfer of the driving motion of the cam drive to the pump piston takes place via a tappet bolt, which acts upon the pump piston via a tappet insert. The tappet insert is disposed in a guide bush, which slides into a housing-mounted guide tube and which transfers the restoring force of a spring to the pump piston, which is fixed between the guide bush and the tappet insert via a coupling part.

Guiding and securing the end of the tappet bolt facing the pump piston is relatively expensive, since the axial securing of the tappet bolt in the tappet insert in the known unit fuel injector is achieved via a securing ring that is locked in the tappet and is fixed in an axial position between the face end of the tappet insert and an intermediate bush; the intermediate bush, for its part, is held axially on the tappet bolt via a snap ring in the bore of the guide bush into which the tappet bolt is guided.

This costly axial securing of the tappet bolt in the tappet insert makes manufacture and installation expensive. Furthermore, because in the operating state of the pump, this connection between the tappet bolt and the pump piston is nondetachable, this inevitably leads to the malfunction of the cam drive in the event of a jammed piston, i.e. blocking of the pump piston.

OBJECT AND SUMMARY OF THE INVENTION

The fuel injection device according to the invention has an advantage over the prior art that through the use of an axial securing element having elastic properties, the tappet bolt can be assembled or disassembled, with the securing element inserted, without the need for further components and disassembly of the pump, and thereby considerably reducing the cost of manufacture and assembly.

The use of a ball joint-like connection brings the additional advantage that a compensation of alignment deviations between the longitudinal position of the tappet bolt and the pump piston becomes possible without disrupting its function. In order to make consistent use of this effect, the connection between the tappet bolt and the tappet insert, as well as the connection between the tappet bolt and the transfer element to the camshaft, is embodied in the manner of a ball joint and is axially secured in an advantageous manner via an elastic securing element. This elastic deformability of the securing element not only simplifies the installation of the tappet bolt but also, in the event of a blocked pump piston, protects the cam drive from a mechanical failure, since in that event, the transfer element is pulled out of its mount in the tappet bolt.

Accordingly, it is especially advantageous to embody each ball joint-like connection by means of a ball head guided in a socket; this ball should contact the socket over a maximum angle of 180° in order to guarantee trouble-free insertion of the ball head into and withdrawal from the socket. As previously mentioned, the axial securing is guaranteed via a securing element with elastic properties; this securing element, which can be brought into contact with the side of the ball bolt remote from the socket, is stretchable so that, depending upon its design, the applicable ball bolt can be passed through it by exerting a certain force.

In a first exemplary embodiment, the elastic securing element is advantageously embodied as an O-ring which has a limited deformability as well as a high thermal resistance and mechanical strength.

The design of the groove in which the ring is guided provides for the radial play required to ensure trouble-free expansion of the ring while the ball bolt is being guided through it. It is advantageously possible to adjust the force necessary for the assembly, or the automatic emergency disengagement of the ball head, via the sizing of the ring and of the groove.

The various embodiments of snap rings recited herein have the advantage that being commercially available components, they can be procured easily and at low cost; the use of circular spring wire further strengthens the elastic properties of this snap ring.

The embodiment of the securing element offers the advantage that an annular groove can be foregone, which makes possible a shortening of the component which carries it.

In order for the fuel injection device to directly cooperate with the cam drive of the engine to be supplied, its movement is advantageously transferred to the tappet bolt by a rocker.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
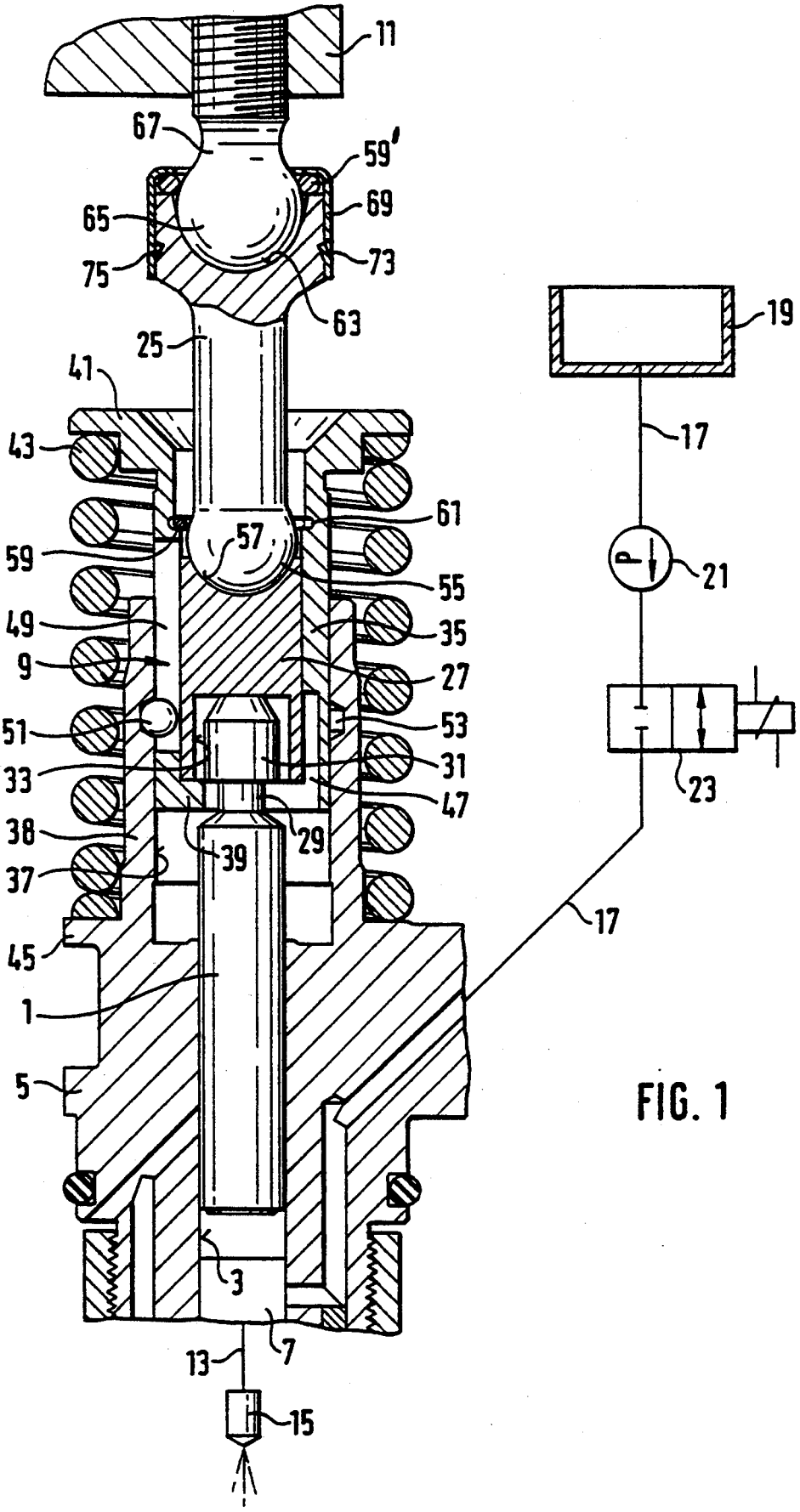
FIG. 1 shows a longitudinal section through a part of a unit fuel injector, schematically showing the adjoining components important to its operation, in which the location of the tappet piston and its connection to the adjoining components are depicted, as well as a first exemplary embodiment of its axial securing in the form of a circular snap ring.

In the unit fuel injector shown in FIG. 1, of which only the regions essential to the invention are described, a pump piston 1 is axially guided in a cylinder bore 3 of a pump housing 5 and defines a pump work chamber 7 with its face end. With its end remote from the pump work chamber 7, the pump piston protrudes into a tappet 9, which is connected to a rocker 11 of a cam drive not shown, via which the pump piston is driven to move axially back and forth. The pump work chamber 7 is connected via a pressure line 13 to an injection valve 15, which protrudes into the combustion chamber of the engine to be supplied. When the pressure in the pump work chamber 7 and in the pressure line 13 reaches a set injection pressure, the injection valve opens counter to the force of a spring; once the pressure drops below this set injection pressure, the valve closes again.

To supply the pump work chamber 7 with fuel, a fuel line 17 discharges into it, leading from a fuel supply tank; a fuel feed pump 21 and a magnetically triggered reversing valve 23 are disposed in this fuel line. The reversing valve 23 is triggered depending upon operating parameters of the engine and regulates the onset and end of high pressure delivery via its opening and closing.

The tappet connection 9 that drives the pump piston comprises a tappet bolt 25, which axially acts upon the pump piston 1 via a cylinder-shaped tappet insert 27 inserted in a tappet sleeve 35, and which on its face end remote from the tappet insert 27 is acted upon by the rocker 11. To that end, the pump piston 1 has a head piece 31, on its end remote from the pump work chamber 7, which is created by means of an annular recess 29 and protrudes into the tappet sleeve 35, and with which the pump piston 1 protrudes into a bore 33 of the tappet insert 27 and with whose face end the pump piston 1 rests on the tappet insert 27. The tappet insert 27 is guided in the tappet sleeve 35, which for its part is axially guided sliding in a bore 37 of a tubular neck 38, which bore runs coaxial to the cylinder bore 3, and which tappet sleeve 35, on its face end oriented toward the pump piston 1, has a region 39 that is angled inward, which embodies a blind bore having a through opening for the head piece 31. To enable installation of the pump piston 1 in the tappet sleeve, the tappet sleeve 35, in its angled region 39, has an eccentric bore 47 by means of which, upon preassembly of the tappet 9, the head 31 of the pump piston 1 is threaded into the tappet sleeve 35 and is then fixed in the middle, and hence in contact with the angled region 39 by means of the bore 33 of the tappet insert 27.

The tappet sleeve 35 has an oblong groove 49, in which a ball 51 is disposed, which is guided in an annular groove 53 of the bore 37, to prevent relative rotation and to limit the axial stroke of the tappet sleeve 35 in the bore 37 of the pump housing 5.

On its end remote from the pump piston 1, the tappet sleeve 35 widens, forming a flange 41 that is engaged by a restoring spring 43 that encompasses the tappet sleeve 35 and the tubular neck 38, and that is supported on its other end on a housing shoulder 45 of the pump housing 5. Via the tappet sleeve 35, the restoring spring 43 consequently acts counter to the tappet motion in the direction of the pump work chamber 7, and upon its intake stroke and with the returning tappet 9 brings the pump piston 1, which is coupled with the tappet sleeve 35, back to its initial position, i.e., top dead center.

On its side oriented toward the pump piston 1, the tappet bolt 25 has a ball head 55, which, on its side remote from the pump piston 1, on the end of the shaft of the tappet bolt 25, has a face in the form of part of a sphere, with whose face end the tappet bolt 25 is supported over an angular range of at most 180° in a ball-and-socket fashion in a ball socket 57 formed on the face end of the tappet insert 27. An axial securing of the tappet bolt 25 against slipping out in the relieved, pressureless state at the end of the outward movement of the pump piston 1 is effected in this exemplary embodiment via a circular securing ring 59, which is supported in an annular groove 61 in the bore 37 on the side of the ball head 55 remote from the tappet insert 27, so that if the tappet bolt 25 is removed with a certain force, the securing ring 59 can expand to the size of the external diameter of the ball head 55.

On the end protruding out of the tappet 9, the tappet bolt 25 has a ball socket 63, supported in which is a ball head 65 of a rocker bolt 67, which is screwed at a right angle into the rocker 11. This ball head 65 is analogous to the ball head 55, but its diameter is larger than the tappet shaft. The ball head 63 of the rocker bolt 67 is likewise secured via a circular elastic securing ring 59', which engages the ball head 65 from behind via a flanged-over sheet metal sleeve 69 that is slipped onto the rocker bolt 67 before the installation of the rocker bolt 67 in the tappet bolt 25, thus keeping the ball head 65 in contact with the ball socket 63; the sheet metal sleeve 69 is axially secured via a plurality of stamped spring tongues 73, distributed over the circumference, that engage a groove 75 on the outer circumference of the ball socket 63.

Figure 2:
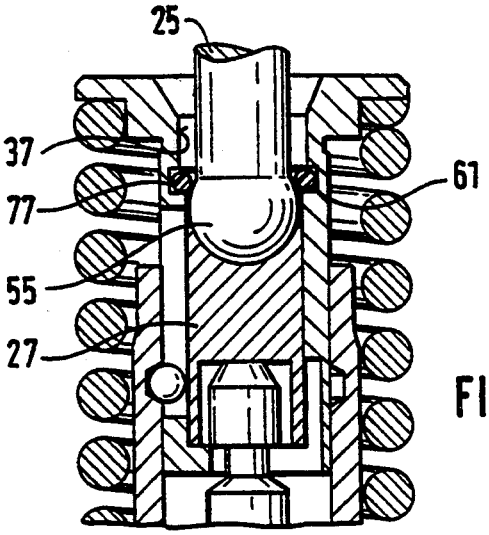
FIG. 2 shows a second exemplary embodiment of the axial securing between the tappet bolt and a tappet insert, which connects the bolt to the pump piston, in which an O-ring is inserted in the bore of the tappet sleeve that guides the tappet insert.

The exemplary embodiment shown in FIG. 2 differs from that in FIG. 1 only in the manner of axial securing of the tappet bolt 25 in the bore 37 of the tappet sleeve 35. The securing element is embodied here by means of an O-ring 77 having elastic properties (e.g. a Vitton ring), which is guided in an annular groove 61, whose cross section is semicircular or rectangular, so that in response to a certain force, it can expand to the size of the outer diameter of the ball head 55, thus enabling simple installation of the tappet bolt 25 in the tappet insert 27.

Figure 3:
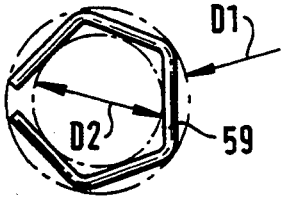
FIGS. 3 through 6 show further variant embodiments of the snap ring shown in FIG. 1.

FIGS. 3 through 6 show different exemplary embodiments of the securing rings 59. In FIG. 3, the securing ring 59 takes the form of an open wire lock washer that is bent into a five-sided closed polygonal shape, whose outer diameter D1 is equal to the base diameter of the groove and whose inner diameter D2 is smaller than the outer diameter of the ball head 55, 65. The installation or removal of the tappet bolt 25 can be varied by way of the rigidity of the circular wire.

Figure 4:
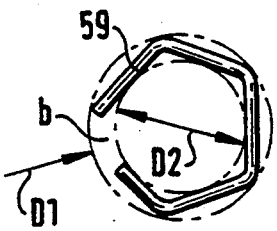

In the snap ring shown in FIG. 4, the lateral side at gap b is shortened to prevent an overlapping of the side during installation and an attendant increase in installation effort and expense.

Figure 5:
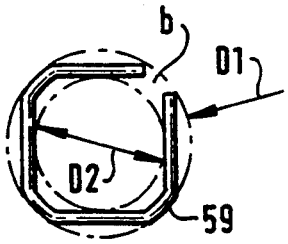

Compared to those shown in FIGS. 3 and 4, the snap ring shown in FIG. 5 has four sides with transitions between them in the shape of a segmented circle, which increase its rigidity.

Figure 6:
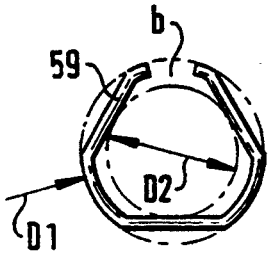

FIG. 6 shows an embodiment of a snap ring, having three sides with transitions between them in the shape of a segmented circle, whose inner and outer diameters are sized analogous to FIG. 3 but the large gap measurement b allows a very simple installation with higher elasticity in response to the intended expansion.

The arc-shaped transitions between the individual sides make it possible to securely guide the securing ring 59 in the groove that receives it by means of their greater contact surface area on the outer diameter, in comparison to angular transitions.

Figure 7:
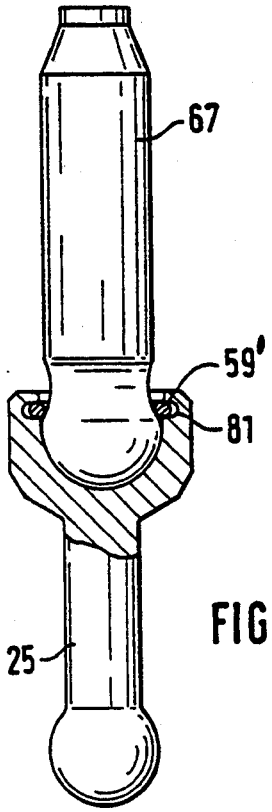
FIG. 7 shows an exemplary embodiment in which the axial securing of the connection between the tappet bolt and a rocker bolt that drives it is achieved via a securing ring, which is guided in an annular groove of the tappet bolt.
Figure 8:
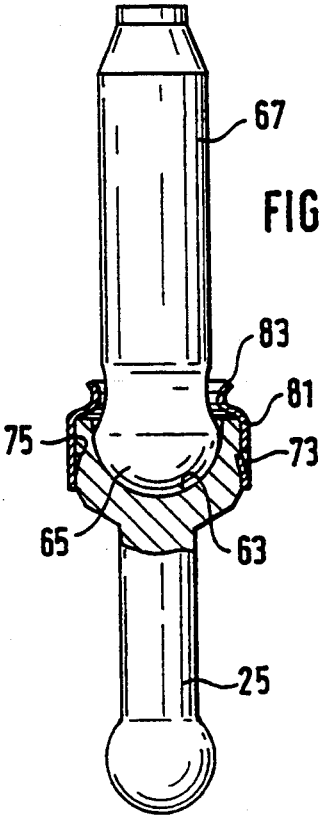
FIG. 8 shows a further exemplary embodiment analogous to FIG. 7, in which the axial securing between rocker bolt and tappet bolt is achieved via one or several profiled sheet metal parts slid onto the tappet bolt.

FIGS. 7 and 8 show further exemplary embodiments of the axial securing of the rocker bolt 67 to the tappet bolt 25; in FIG. 7, the securing ring 59 is guided directly in a groove 81 in the tappet bolt 25.

In the exemplary embodiment shown in FIG. 8, the axial securing of the rocker bolt 67 is achieved via a profiled sheet metal part 81 embodied as a ring sleeve, which is locked onto the tappet bolt 25 via detent elements 73 embodied as spring tongues, which engage in a groove 75 on the outer circumference of the head of the ball socket 63; the upper end piece 83 of this profiled sheet metal part 81 protrudes outward via the tappet bolt 25 and is angled so that it engages the ball head 65 of the rocker bolt 67 and thus secures it against slipping axially out of the socket 63.

Both the ball joint-like connection between the rocker bolt 67 and the tappet bolt 25 and that between the tappet bolt 25 and the tappet insert 27 could also be embodied in a reverse fashion in which the ball socket would be disposed on the rocker bolt 67 or the ball head would be disposed on the tappet insert 27.

Axially securing the tappet bolt 25 with regard to the tappet insert 27 and the rocker bolt 67 using deformable securing elements, in accordance with the invention, not only securing against destruction of the tappet drive in the event of blocking of the pump piston 1, but also enable simple installation of the tappet bolt 25 without disassembling the entire pump, hence considerably reducing the production cost.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection device for internal combustion engines, having a pump piston (1) guided in a cylinder bore (3) disposed in a pump housing (5), a cam drive for driving the pump piston axially back and forth counter to a force of a restoring spring (43), said pump piston having one face end, remote from the cam drive, defining a pump work chamber (7) that communicates with an injection valve (15) via a pressure line (13) and can be filled with fuel via a fuel line (17), a tappet bolt (25) by which the cam drive acts upon the pump piston (1), said tappet bolt (25) includes a spherical tappet end remote from the cam drive which is guided in a ball socket (57) of a tappet insert (27) joined to the pump piston (1), said spherical tappet end remote from the cam drive forms a ball head end (55) with a partially spherical face remote from the tappet insert (27) and ending at a shaft of the tappet bolt (25), and the tappet bolt (25) is axially secured in place by a first securing element (59) between the partially spherical face on the head end (55) of the tappet bolt (25) remote from the tappet insert (27) and a tappet sleeve (35), and said first securing element (59) is embodied as an elastic securing element, which at least enables a fixed axial motion of the tappet bolt (25) in the tappet sleeve (35) and said first elastic securing element (59) is locked in detent fashion in a recess (61) of the tappet sleeve.

2. A fuel injection device according to claim 1, in which the tappet bolt (25), on its end remote from the pump piston (1), is connected in a ball-and-socket joint to a transfer member (67) driven by the cam drive.

3. A fuel injection device according to claim 2, in which the ball-and-socket joint comprises a ball socket (63) and a ball head (65), which is engaged from behind by a second elastic securing element (59') held in the ball socket (63).

4. A fuel injection device according to claim 1, in which the first elastic securing element (59) is embodied as an O-ring, which is guided with enough play in said recess (61) which is configured as an annular groove of semicircular cross section, in which said annular groove is deep enough to allow the first elastic securing element to expand, that with an inner diameter the first elastic securing element can widen to a size of an outer diameter of the ball head (55).

5. A fuel injection device according to claim 3, in which the first elastic securing element (59) is embodied as an O-ring, which is guided with enough play in said recess (61) which is configured as an annular groove of semicircular cross section, in which said annular groove is deep enough to allow the first elastic securing element to expand, that with an inner diameter the first elastic securing element can widen to a size of an outer diameter of the ball head (55).

6. A fuel injection device according to claim 1, in which the first elastic securing element (59) is embodied as an O-ring, which is guided with enough play in said recess (61) which is configured as an annular groove of rectangular cross section, in which said annular groove is deep enough to allow the first elastic securing element to expand, that with an inner diameter the first elastic securing element can widen to a size of an outer diameter of the ball head (55).

7. A fuel injection device according to claim 3, in which the first elastic securing element (59) is embodied as an O-ring, which is guided with enough play in said recess (61) which is configured as an annular groove of rectangular cross section, in which said annular groove is deep enough to allow the first elastic securing element to expand, that with an inner diameter the first elastic securing element can widen to a size of an outer diameter of the ball head (55).

8. A fuel injection device according to claim 1, in which the first elastic securing element (59) is embodied as a circular snap ring, which is guided in an annular groove, in which the annular groove is sized so that the annular groove enables a diameter expansion of the inserted snap ring that is required in order to allow the installation of the particular ball head (55).

9. A fuel injection device according to claim 3, in which the first elastic securing element (59) is embodied a circular snap ring, which is guided in an annular groove, in which the annular groove is sized so that the annular groove enables a diameter expansion of the inserted snap ring that is required in order to allow the installation of the particular ball head (55).

10. A fuel injection device according to claim 1, in which the first elastic securing element (59) takes the form of an open wire lock washer that is bent into a five-sided, closed polygonal shape, whose outer diameter D1 is equal to a base diameter of the recess (61) and whose inner diameter D2 is smaller than the outer diameter of the ball head (55).

11. A fuel injection device according to claim 3, in which the first elastic securing element (59) takes the form of an open wire lock washer that is bent into a five-sided, closed polygonal shape, whose outer diameter D1 is equal to a base diameter of the recess (61) and whose inner diameter D2 is smaller than the outer diameter of the ball head (55).

12. A fuel injection device according to claim 10, in which a defined increased spacing (b) is provided between the ends of the wire lock washer, by shortening one of the sides.

13. A fuel injection device according to claim 1, in which the first elastic securing element (59) takes the form of an open wire lock washer that is bent into a four-sided, closed polygonal shape, whose transitions between the sides of the polygon are embodied in a circular shape.

14. A fuel injection device according to claim 3, in which the first elastic securing element (59) takes the form of an open wire lock washer that is bent into a four-sided, closed polygonal shape, whose transitions between the sides of the polygon are embodied in a circular shape.

15. A fuel injection device according to claim 1, in which the first elastic securing element (59) takes the form of an open wire lock washer that is bent into a three-sided, closed polygonal shape, whose transitions between the sides of the polygon are embodied in a circular shape.

16. A fuel injection device according to claim 3, in which the first elastic securing element (59) takes the form of an open wire lock washer that is bent into a three-sided, closed polygonal shape, whose transitions between the sides of the polygon are embodied in a circular shape.

17. A fuel injection device according to claim 8, in which the snap ring is formed as a wire having a circular cross section.

18. A fuel injection device according to claim 10, in which the snap ring is formed as a wire having a circular cross section.

19. A fuel injection device according to claim 3, in which the second elastic securing element is a profiled sheet metal part (81) embodied as a ring sleeve, which is locked in detent fashion to a circumferential wall of a part of the tappet bolt (25) forming the ball socket (63) via detent elements (73), and which has spring components (83) that protrude into a region where the ball head (65) enters the socket (63).

20. A fuel injection device according to claim 2, in which a transfer of a motion from the cam drive to the tappet bolt (25) is effected by means of a rocker (11), and a rocker bolt (67) serves as a transfer member which is screwed into an end of the rocker oriented toward the tappet bolt (25), and an end of the rocker bolt (67) that acts upon the tappet bolt (25) is embodied as a ball head (65), which engages the end of the tappet bolt (25) that is embodied as a ball socket (63), that forms the aforementioned ball-and-socket joint.

* * * * *